US009601300B2

(12) United States Patent
Neuser et al.

(10) Patent No.: US 9,601,300 B2
(45) Date of Patent: Mar. 21, 2017

(54) CATHODE ELEMENT FOR A MICROFOCUS X-RAY TUBE

(75) Inventors: Eberhard Neuser, Wunstorf (DE); Andreas Schmitt, Wunstorf (DE); Wolfgang Sperner, Wunstorf (DE)

(73) Assignee: GE Sensing and Inspection Technologies GMBH, Huerth (DE)

( * ) Notice: Subject to any disclaimer, the term of this patent is extended or adjusted under 35 U.S.C. 154(b) by 71 days.

(21) Appl. No.: 13/638,600

(22) PCT Filed: Apr. 9, 2010

(86) PCT No.: PCT/EP2010/002223

§ 371 (c)(1),
(2), (4) Date: Sep. 29, 2012

(87) PCT Pub. No.: WO2011/124237

PCT Pub. Date: Oct. 13, 2011

(65) Prior Publication Data

US 2013/0039475 A1 Feb. 14, 2013

(51) Int. Cl.

| | |
|---|---|
| ***H01J 35/00*** | (2006.01) |
| ***H01J 35/06*** | (2006.01) |
| ***H01J 1/16*** | (2006.01) |
| ***H01J 35/14*** | (2006.01) |

(52) U.S. Cl.
CPC ..... *H01J 35/06* (2013.01); *H01J 1/16* (2013.01); *H01J 35/14* (2013.01)

(58) Field of Classification Search
CPC ..... H01J 35/14; H01J 1/16
USPC ..... 378/136, 138, 140
See application file for complete search history.

(56) References Cited

U.S. PATENT DOCUMENTS

| | | | | |
|---|---|---|---|---|
| 3,732,426 | A * | 5/1973 | Shimizu | G01N 23/223 250/399 |
| 3,857,055 | A * | 12/1974 | Shirai | H01J 37/065 313/237 |
| 4,979,199 | A * | 12/1990 | Cueman | H01J 35/14 378/121 |
| 6,600,809 | B1 * | 7/2003 | Ochiai | G01N 23/04 378/101 |
| 6,778,633 | B1 * | 8/2004 | Loxley | H01J 35/14 378/113 |

(Continued)

FOREIGN PATENT DOCUMENTS

| | | |
|---|---|---|
| CN | 101536135 A | 9/2009 |
| DE | 22 49 365 A1 | 4/1974 |

(Continued)

OTHER PUBLICATIONS

F.J. Simons et al., "Quantitative Characterization of Coal by Means of Microfocal X-Ray Completed Microtomography . . . ", Int'l Journal of Coal Geology 34, 1997, p. 69-88.

(Continued)

*Primary Examiner* — Michael Maskell
(74) *Attorney, Agent, or Firm* — GE Global Patent Operation

(57) ABSTRACT

A cathode element for a microfocus x-ray tube includes a heatable filament formed of a wire for thermionic emission of electrons for generating an electron beam. The filament, in a source area of the electron beam, has an elongate extension in two directions perpendicular to the electron beam.

13 Claims, 3 Drawing Sheets

(56) References Cited

U.S. PATENT DOCUMENTS

| | | | | |
|---|---|---|---|---|
| 8,121,258 | B2 * | 2/2012 | Hoghoj | B82Y 10/00 378/125 |
| 2003/0099327 | A1 * | 5/2003 | Matsushita | H01J 35/06 378/138 |
| 2005/0141670 | A1 * | 6/2005 | Ichikawa | H01J 35/14 378/138 |
| 2007/0092064 | A1 * | 4/2007 | Kuribayashi | H01J 35/06 378/136 |
| 2009/0129550 | A1 * | 5/2009 | Bandy | H01J 1/135 378/141 |
| 2009/0242744 | A1 * | 10/2009 | Erler | G01N 23/046 250/252.1 |
| 2010/0067664 | A1 | 3/2010 | Tamura et al. | |
| 2010/0079053 | A1 | 4/2010 | Andrews et al. | |
| 2010/0195799 | A1 * | 8/2010 | Tomita | H01J 35/14 378/138 |

FOREIGN PATENT DOCUMENTS

| | | | |
|---|---|---|---|
| EP | 0273162 | A2 | 7/1988 |
| JP | S5444688 | U | 3/1979 |
| JP | S63105427 | A | 5/1988 |
| JP | H04296431 | A | 10/1992 |
| JP | 2007 165236 | A | 6/2007 |

OTHER PUBLICATIONS

Unofficial translation of CN Office Action issued on Nov. 4, 2015 in connection to corresponding CN Application 201080065686.2.

Unofficial English Translation of Office Action and Search Report issued in connection with corresponding CN Application 201080065686.2 on Sep. 23, 2014.

Unofficial English Translation of Office Action issued in connection with corresponding EP Application No. 10716475.8 on Apr. 12, 2016.

* cited by examiner

CATHODE ELEMENT FOR A MICROFOCUS X-RAY TUBE

CROSS REFERENCE TO RELATED PATENT APPLICATIONS

This patent application is filed herewith for the U.S. National Stage under 35 U.S.C. §371 and claims priority to PCT application PCT/EP2010/002223, with an international filing date of Apr. 9, 2010. The contents of this application are incorporated in their entirety herein.

STATEMENT REGARDING FEDERALLY-SPONSORED RESEARCH OR DEVELOPMENT

Not applicable.

TECHNICAL FIELD

The present invention relates to a cathode element for a microfocus x-ray tube including a heatable filament formed of a wire for thermionic emission of electrons for generating an electron beam.

BACKGROUND OF THE INVENTION

In microfocus x-ray tubes, hairpin filaments are used where the wire is bent to a pointed tip to emit a fine electron beam in order to obtain a focal spot size in the pm range. However, due to increasingly higher tube currents and higher filament temperatures associated therewith, hairpin filaments have only a relatively short lifetime, and therefore the cathode needs to be replaced at regular intervals after a limited number of operating hours. Significant additional maintenance efforts and corresponding downtimes are thus caused, which constitutes an obstacle to the use of microfocus x-ray tubes in industrial manufacture.

BRIEF SUMMARY OF THE INVENTION

It is therefore an object of the present invention to provide a cathode element for a microfocus x-ray tube having an extended lifetime. The present invention achieves this object as described in the specification, drawings and claims presented herein.

Due to the elongate extension of the filament in two directions perpendicular to the electron beam, in the source area of the electron beam, the effective electron emitting surface can significantly be increased so that, compared to the essentially point-shaped extension of the electron emitting tip of a hairpin filament, a significantly lower filament temperature suffices for emitting the same electron current. Elongate extension of the filament means that the extension is significantly larger, in particular at least 50% larger than the thickness of the wire, and preferably at least twice as large, and further preferably at least three times as large. The lower filament temperature results in a significant extension of the lifetime of the filament and thus of the cathode element. A multiplied filament lifetime, increased by an order of magnitude and more, can be achieved with the present invention. Surprisingly, it has turned out that in spite of the increased electron emitting surface a focal spot size of less than 10 μm, and preferably 7 μm or less, can still be obtained. Owing to the present invention, high-resolution microfocus x-ray inspection systems can therefore be used in industrial manufacture.

In the source area of the electron beam the filament comprises a plurality of wire portions which are arranged next to each other. Thus, the present invention can be realized in a simple way by one single wire. In one embodiment which is particularly simple to manufacture, the wire portions are formed by a plurality of wire loops so that the electron emitting area of the filament has the shape of a wire coil.

The wire portions are arranged so as to be spaced from each other. Thus, the wire flanks, i.e. the side surfaces of the wire between the wire portions, can further contribute to the electron emitting surface, with the result that the inventive effect can be enhanced.

At least three wire portions may be utilized to obtain a significant increase of the electron emitting surface. Up to ten wire portions may be utilized, and preferably a maximum of six electron emitting wire portions may be utilized, so as to be able to obtain a microfocus, i.e. a focal spot of the electron beam not exceeding 10 μm. An uneven number of wire portions is advantageous, since the beam profile of the electron beam improvise due to the presence one wire portion located exactly in or substantially near the center. Therefore, embodiments may utilize three, five or seven wire portions accordingly.

The cathode element is designed as a replaceable unit for being inserted into an adapted mounting of a microfocus x-ray tube. In this manner, depending on the application, an inventive cathode element or a conventional cathode element comprising a hairpin filament can be inserted into the adapted mounting of an inventive microfocus x-ray tube.

An inventive microfocus x-ray tube may also include a condenser lens to align the electron beam approximately parallel when using an inventive cathode element. That way, in particular when using a downstream conventional focusing lens, the specified nominal values of the tube can be obtained independent of the type of the inserted cathode element. When using a cathode element comprising a hairpin filament the condenser lens is conveniently switched off. There is no need for adapting the focusing lens to the inventive cathode element.

The present invention will be described in more detail on the basis of preferred embodiments as follows and with reference to the accompanying drawings.

DETAILED DESCRIPTION OF THE INVENTION

Figure 1:
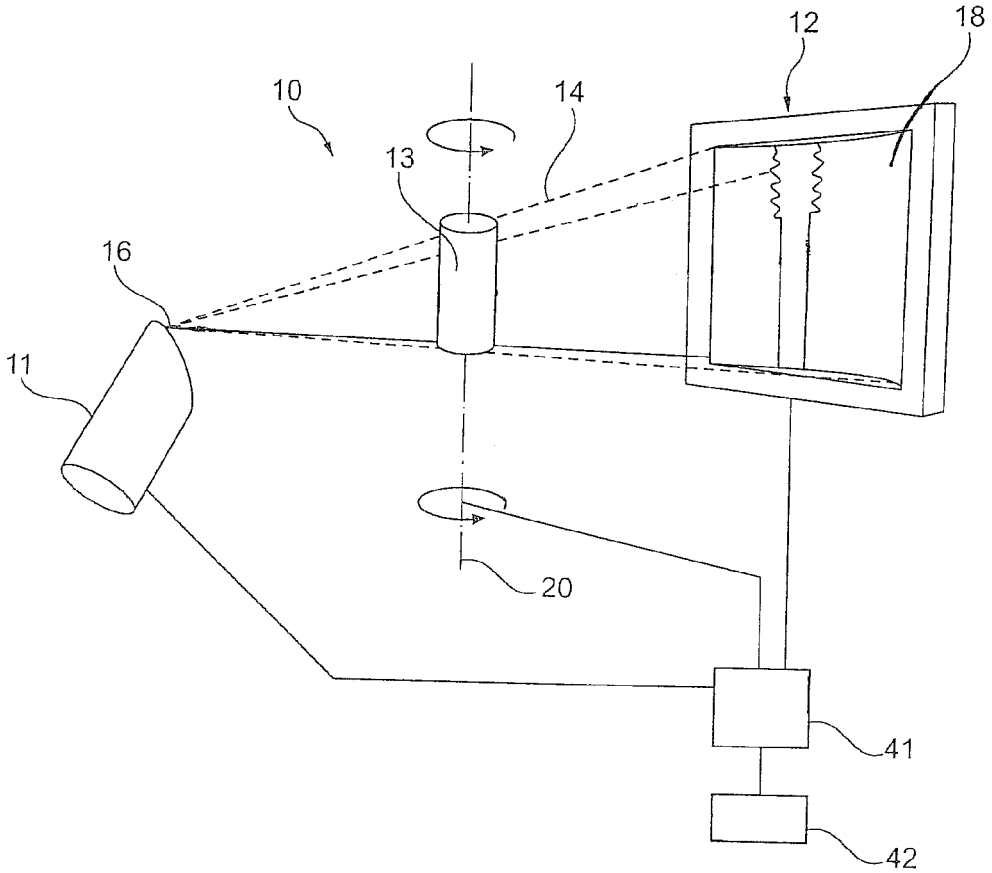
FIG. 1 is a schematic illustration of a micro-computer tomography system.
Figure 2:
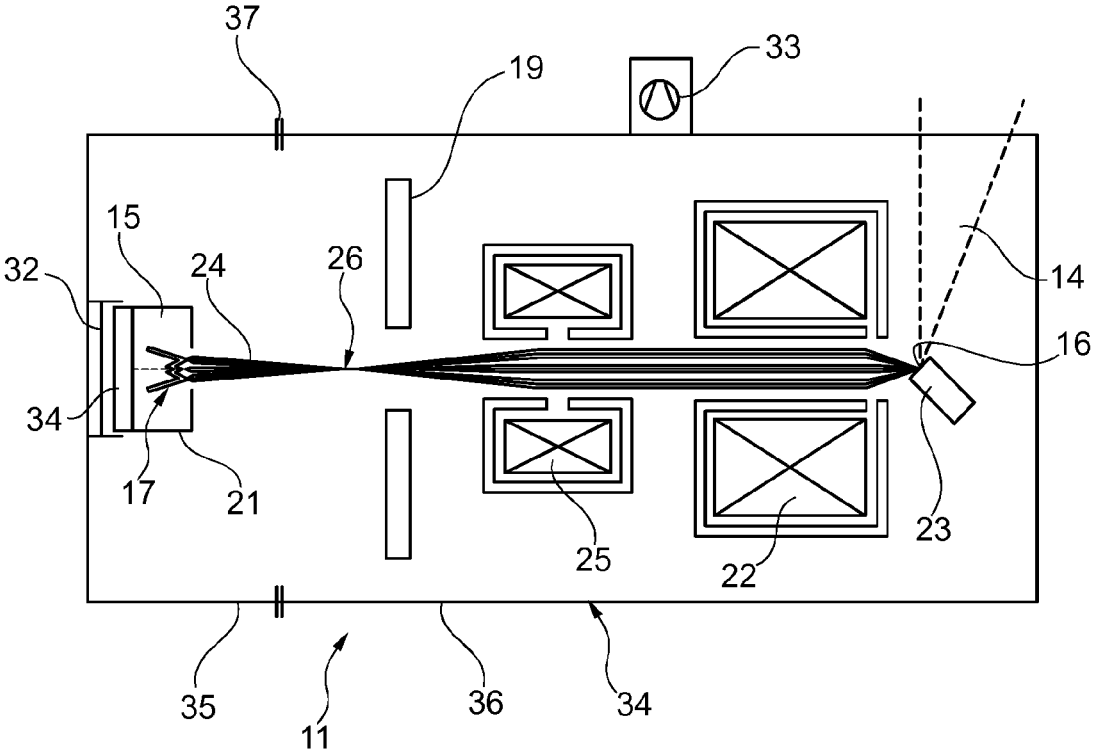
FIG. 2 is a schematic cross-sectional view of a microfocus x ray tube with an inserted cathode element according to FIG. 3 and FIG. 4.

The micro-computer tomography system shown in FIG. 1 includes an x-ray system 10 which is adapted to record a set of x-ray projections of a sample 13. For this purpose, the x-ray system 10 includes a microfocus x-ray tube 11 which emits x-radiation 14 originating from a focal spot or focus 16 of the x-ray tube 11, an imaging x-ray detector 12 and a sample holder 20 which preferably is adapted to rotate the sample 13 around a vertical axis. The x-ray detector 12 is preferably an area detector, in particular a flat panel detector; however, a line detector is also possible. A set of x-ray projections of the sample 13 is obtained for example by successively rotating the sample holder 20 around a predefined small angular step at a time and recording an x-ray projection at each angle of rotation. The x-ray system 10 is not limited to a rotation of the sample holder 20 around a vertical axis. Alternatively, for example the x-ray tube 11 and the x-ray detector 12 can be rotated around the fixed sample 13.

The x-ray projections are read out from the x-ray detector 12 and are transmitted to a computer device 41 in which reconstructed three-dimensional volume data of the sample 13 are calculated from the recorded set of x-ray projections using a generally known reconstruction algorithm and are displayed for example on a monitor 42. As shown in FIG. 1, the computer device 41 can also be adapted to control the x-ray source 11, the sample holder 20 and the x-ray detector 12; alternatively, a separate control device may be provided.

The microfocus x-ray tube 11 in particular includes a cathode element 15, a Wehnelt cylinder 21, an anode 19, a focusing lens 22 which preferably is designed as an electromagnetic lens, and an electron beam target 23. Moreover, a further electromagnetic lens 25 may be provided which preferably is designed as a condenser lens for aligning the electron beam 24 approximately parallel; however, the condenser lens 25 is not compulsory. The microfocus x-ray tube 11 conveniently further includes a not-shown deflector unit for beam position adjustment.

The cathode element 15 includes a filament 17 which is made of a suitable wire 27, in particular of tungsten, and is mounted on an insulating socket 34 which for example is made of a ceramic material. The filament wire 27 preferably has a strength in the range of 100 μm to 300 μm, for example approximately 200 μm. A heating voltage is applied to the ends of the filament 17 for thermionic emission of electrons from the filament wire 27. An accelerating voltage generated by a not-shown high-voltage generator is applied between the filament 17 and the anode 19 to accelerate the electrons extracted from the wire towards the anode 19 and to generate an electron beam 24. The maximum accelerating voltage preferably is at least 100 kV, preferably at least 200 kV.

The generated electron beam is focused on the target 23 by the focusing lens 22 in order to generate x-radiation 14. The target 23 preferably is arranged in a reflecting arrangement (direct beam target). The massive target 23 can absorb a comparatively high power so that the x-ray tube 11 is advantageously adapted to generate a maximum tube current of at least 1 mA and/or a maximum tube power of at least 100 W. Thus, the x-ray tube 11 is suited for the inspection of relatively thick samples like for example casted parts.

The present invention is not limited to a direct beam target. The inventive filament 17 in particular may also be used in an x-ray tube 11 comprising a transmission target. In view of this, the maximum tube current preferably is at least 0.5 mA and/or the maximum tube power is at least 50 W.

In order to obtain a detail resolution in the x-ray image of well below 10 μm, which is desired in micro-computer tomography, it is necessary that the size of the electron beam focal spot 16 on the target 23 is below 10 μm. For this purpose, the electron beam 24 first is focused using a Wehnelt cylinder or grid 21 lying on a suitable negative potential relative to the filament 17, in order to create a sharp cross-over point 26. Cathode 17, Wehnelt cylinder 21 and anode 19 thus form a triode. Behind the anode 19 the electron beam is further focused on the focal spot 16 of the target using a focusing lens 22. In general, the electron optics of the tube 11, here consisting of Wehnelt cylinder 21, focusing lens 22 and, if required, condenser lens 25, is adapted to create a focal spot 16 having an average diameter of 10 μm or less.

Figure 3:
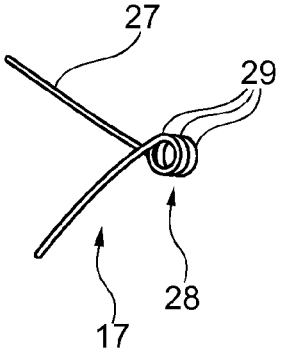
FIG. 3 is a perspective view of a filament according to one embodiment of the present invention.
Figure 4:
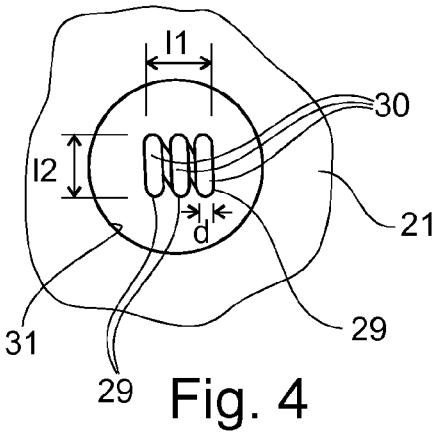
FIG. 4 is a view of a cathode unit with the filament shown in FIG. 3 against the direction of the electron beam.

In a preferred embodiment according to FIG. 3 and FIG. 4, the electron emitting area 28 of the filament 17 is formed by a plurality of loops 29 which may be arranged essentially parallel to each other. The filament 17 in this embodiment is a single-coiled filament. Preferably, there are at least three loops 29. In the embodiment of FIG. 3 and FIG. 4, three loops 29 are shown which may be an optimum number. Furthermore, there preferably are not more than ten loops 29, further preferably not more than seven loops 29, in order to limit the extension of the electron emitting area in respect of the requested resolution of detail in the x-ray image.

The surface of the filament facing the target 23, which forms the main source of the electron beam 24, is formed by a plurality of wire portions 30, as is shown in FIG. 4. The wire portions 30 preferably are aligned essentially parallel and as a result show an overall planar extension of the surface of the filament 17 facing the target 23, with a first elongate extension l1 perpendicular to the electron beam and a second elongate extension l2 perpendicular to the electron beam and perpendicular to the extension l1 (see FIG. 4). Elongate extension means that l1 and l2 are significantly larger than the thickness d of the wire, in particular at least 50% larger, preferably at least twice as large, further preferably at least three times as large, in the present embodiment approximately four times as large. In comparison to the "point-shaped" surface of the tip of a hairpin filament having an extension of approximately d2, an electron emitting surface of the filament 17 which is extended by up to a factor of three and more is provided by the present invention. Consequently, for generating the same tube current the heating temperature of the filament 17 can be reduced significantly and thus its lifetime can be extended by a factor of ten and more. The extensions l1 and l2 preferably are about the same size, i.e. they differ from each other for example by not more than 50% in relation to the larger one of the two extensions. The filament 17 preferably is free of tips or kinks with a bending radius in the range of the wire diameter d.

The loops 29 and thus the electron emitting wire portions 30 preferably are spaced from each other, as can be seen in FIG. 4. The distance preferably is smaller than or equal to the thickness d of the filament wire 27 and preferably is in the range of 0.1 d to d, in the present case for example 0.5 d or approximately 100 μm. The spaced arrangement of the wire portions 30 provides the advantage that the flanks or the side surfaces of the wire portions 30 further contribute to the electron emitting surface forming the source of the electron beam. Hereby, the effective electron emitting surface can be further increased without additional effort.

Figure 5:
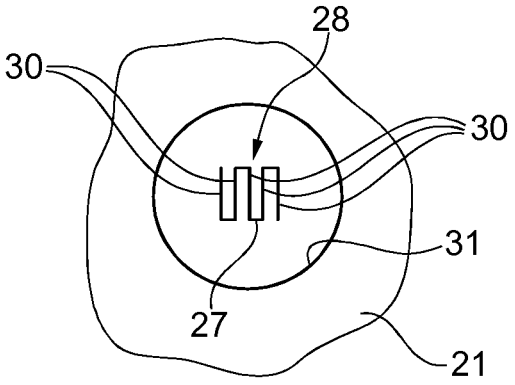
FIG. 5 is a view of a cathode unit with a filament according to a further embodiment of the present invention, against the direction of the electron beam.
Figure 6:
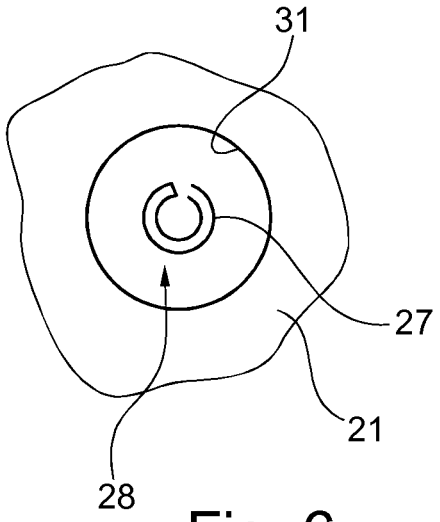
FIG. 6 is a view of a cathode unit with a filament according to a further embodiment of the present invention, against the direction of the electron beam.

The wire portions 30 may also be formed by other means than wire loops 29. In a not-shown embodiment for example each wire portion 30 can be formed by a separate single filament. In the embodiment shown in FIG. 5, for example five wire portions 30 are formed by a serpentine filament. The embodiment according to FIG. 6 shows clearly that an overall planar extension of the surface of the filament wire 27 facing the target 23 can also be realized without straight wire portions 30.

The x-ray tube 11 has an open design, i.e. the tube 11 comprises means for venting and in the vented state can be opened to take out a cathode element 15 and insert a new cathode element 15 in particular when a filament has reached or passed a predetermined operating time. The housing 34 of the x-ray tube 11 for this purpose consists of two housing halves 35, 36 which can be separated from each other at a flange 37. The cathode element 15 designed as a replaceable unit preferably includes the Wehnelt cylinder 21, in order that the centering of the filament 17 relative to the front end opening 31 for the electron beam 24 can already be carried out by the manufacturer and does not have to be carried out by the user of the x-ray tube 11.

After the insertion of a new cathode element 15 the x-ray tube 11 is sealed to be vacuum-tight by connecting the two housing halves 35, 36 and is evacuated to the operating vacuum using a vacuum pump 33 permanently mounted on the x-ray tube 11.

Figure 7:
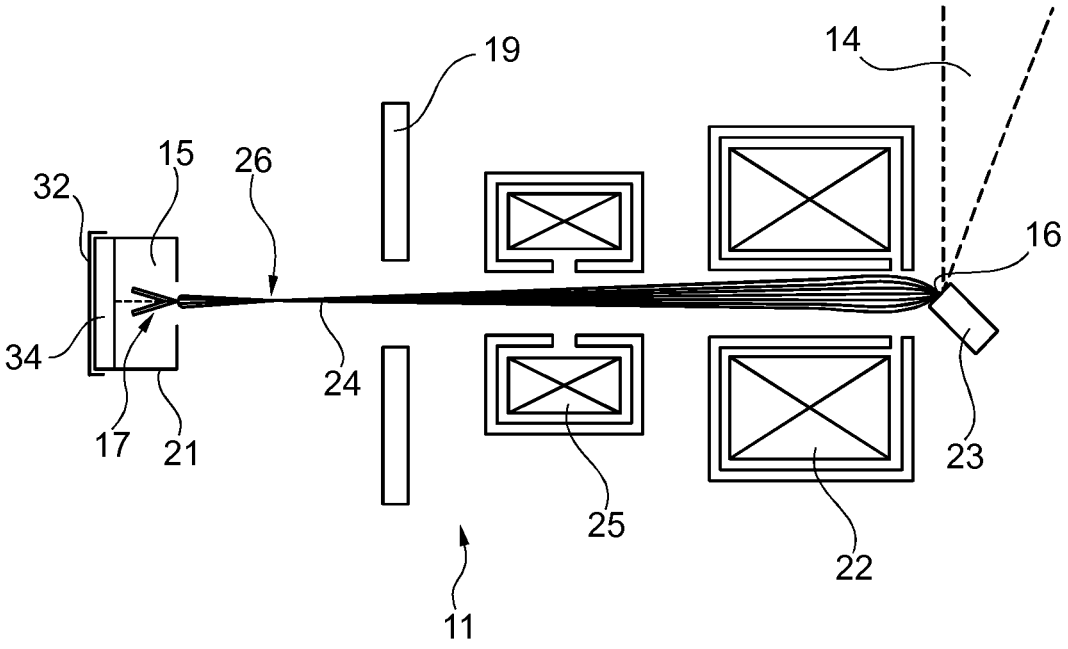
FIG. 7 is a schematic cross-sectional view of a microfocus x ray tube with an inserted cathode element comprising a hairpin filament.

In a preferred embodiment, in particular if a higher detail resolution of the x-ray images is desired, the x-ray tube 11 is adapted to optionally being used with a hairpin filament 17. For this purpose, a cathode element 15 comprising a hairpin filament can simply be inserted into the mounting 32; the x-ray tube 11 in this high-resolution operating state is shown in FIG. 7. There is no need for a further change in the design of the x-ray tube 11, besides the replacement of the cathode element 15, or of the not-shown high-voltage generator. To render this possible, essential parameters of the filament 17 to be used having the essentially planar extension, like wire length and diameter, dimensions like for example loop diameter as well as distances are optimally chosen. When operating the x-ray tube 11 with a hairpin filament the condenser lens 25 preferably is switched off. Thus, the x-ray tube 11 is operated in a conventional manner with the focusing lens 22. The condenser lens 25 preferably is switched off automatically as a result of inserting a cathode element comprising a hairpin filament.

The embodiment shown in FIG. 1 relates to a microcomputer tomography system 10. However, the x-ray tube 11 is also suited for a two-dimensional radiographic testing system without CT reconstruction.

What is claimed is:

1. A cathode element for a microfocus x-ray tube, comprising:

a heatable filament formed of a wire for thermionic emission of electrons for generating an electron beam and a Wehnelt cylinder with a front end opening for the electron beam, characterized in that the cathode element is a replaceable unit for insertion into an adapted mounting of the microfocus x-ray tube including the Wehnelt cylinder and the filament comprises, at an electron beam emitting area of the filament, a first elongate extension extending in a first direction perpendicular to the electron beam and a second elongate extension extending in a second direction perpendicular to the electron beam, wherein a length of the first elongate extension differs from a length of the second elongate extension by not more than 50%, the first and second elongate extension formed by a plurality of wire portions arranged next to each other, the wire portions arranged so as to be spaced apart from each other by a distance less than or equal to a diameter of the wire, wherein the filament is centered relative to the front end opening.

2. The cathode element according to claim 1, wherein the number of wire portions is at least three.

3. The cathode element according to claim 1, wherein the wire portions are formed by a plurality of wire loops of a filament wire.

4. A microfocus x-ray tube comprising:

a cathode element having a heatable filament formed of a wire for thermionic emission of electrons for generating an electron beam and a Wehnelt cylinder with a front end opening for the electron beam, characterized in that the cathode element is a replaceable unit for insertion into an adapted mounting of the microfocus x-ray tube including the Wehnelt cylinder and the filament comprises, at an electron beam emitting area of the filament, a first elongate extension extending in a first direction perpendicular to the electron beam and a second elongate extension extending in a second direction perpendicular to the electron beam, wherein a length of the first elongate extension differs from a length of the second elongate extension by not more than 50%, the first and second elongate extension formed by a plurality of wire portions arranged next to each other, the wire portions arranged so as to be spaced apart from each other by a distance less than or equal to a diameter of the wire, and wherein the filament is centered relative to the front end opening; and a target for generating x-radiation as a result of the electron beam impinging on the target.

5. The microfocus x-ray tube according to claim 4, wherein a focal spot of the electron beam on the target has an average diameter of 10 um or less.

6. The microfocus x-ray tube according to claim 4, wherein the x-ray tube can be vented, opened and sealed to be vacuum-tight for replacing the cathode unit.

7. The microfocus x-ray tube according to claim 4, including a vacuum pump for evacuating the x-ray tube.

8. The microfocus x-ray tube according to claim 7, including a condenser lens which is adapted to align the electron beam approximately parallel.

9. The microfocus x-ray tube according to claim 8, wherein the condenser lens can be switched off if a cathode element comprising a hairpin filament is inserted into the x-ray tube.

10. The microfocus x-ray tube according to claim 4, wherein the maximum tube current is at least 1 mA.

11. The microfocus x-ray tube according to claim 4, wherein the maximum tube power is at least 100 W.

12. A method for microfocus x-ray inspection of a sample, comprising:

generating x-radiation using a microfocus x-ray tube which includes a heatable filament formed of a wire for thermionic emission of electrons for generating an electron beam and a Wehnelt cylinder with a front end opening for the electron beam, characterized by using a cathode element designed as a replaceable unit for insertion into an adapted mounting of the microfocus x-ray tube including the Wehnelt cylinder and the a filament, wherein the filament comprises, at an electron beam emitting area of the filament, a first elongate extension extending in a first direction perpendicular to the electron beam and a second elongate extension extending in a second direction perpendicular to the electron beam, wherein a length of the first elongate extension differs from a length of the second elongate extension by not more than 50%, the first and second elongate extension formed by a plurality of wire portions arranged next to each other, the wire portions arranged so as to be spaced apart from each other by a distance less than or equal to a diameter of the wire, and wherein the filament is centered relative to the front end opening.

13. The cathode element according to claim 1, wherein the wire portions of the filament are arranged side by side next to each other.

* * * * *